United States Patent [19]

Feuchter et al.

[11] 4,250,948

[45] Feb. 17, 1981

[54] DEVICE FOR HANDLING CONTINUOUSLY VERTICALLY CAST RECTANGULAR STRANDS, ESPECIALLY OF ALUMINUM AND ALUMINUM ALLOYS

[75] Inventors: Franz-Peter Feuchter, Oberhausen; Erling Roller, Essen; Klaus-Walter Giertz, Bochum, all of Fed. Rep. of Germany

[73] Assignee: Fried. Krupp Gesellschaft mit beschränkter Haftung, Essen, Fed. Rep. of Germany

[21] Appl. No.: 3,609

[22] Filed: Jan. 15, 1979

[30] Foreign Application Priority Data

Jan. 18, 1978 [DE] Fed. Rep. of Germany ..... 2801972

[51] Int. Cl.[3] ..... B22D 11/128; B22D 45/00

[52] U.S. Cl. ..... 164/269; 164/82; 164/445; 164/448; 414/728; 414/742

[58] Field of Search ..... 164/269, 425, 441, 442, 164/447, 448, 445, 82; 414/416, 421, 728, 742, 777

[56] References Cited

U.S. PATENT DOCUMENTS

| | | | |
|---|---|---|---|
| 3,181,709 | 5/1965 | Kinnicutt, Jr. et al. | 414/777 |
| 3,525,383 | 8/1970 | Golde | 164/269 X |
| 3,630,269 | 12/1971 | Bieri | 164/269 X |
| 4,184,534 | 1/1980 | Peytavin | 164/269 |

FOREIGN PATENT DOCUMENTS

| | | | |
|---|---|---|---|
| 1220563 | 7/1966 | Fed. Rep. of Germany | 164/269 |
| 1608768 | 7/1970 | Fed. Rep. of Germany | 164/269 |
| 1496099 | 9/1967 | France | 164/269 |
| 281769 | 9/1970 | U.S.S.R. | 164/441 |
| 379308 | 7/1973 | U.S.S.R. | 164/269 |

*Primary Examiner*—Robert D. Baldwin
*Assistant Examiner*—Gus T. Hampilos
*Attorney, Agent, or Firm*—Becker & Becker, Inc.

[57] ABSTRACT

A device for handling semi-continuously vertically cast rectangular strands, especially of aluminum and aluminum alloys. The strands are simultaneously adjacent to each other lowered by means of a downwardly movable casting table, brought into engagement with a supporting member, and by a pivoting movement of the dummy bars and of the supporting member which are operatively connected to the casting table are moved into an at least nearly horizontal positon with regard to the casting table. The above mentioned pivoting movement is coupled to the upward movement of the casting table. The strands are cast in such a way that one of their narrow sides is located opposite the supporting member. During the upward movement of the casting table, the supporting member with the strands one narrow side of which engages the supporting member are pivoted about a pivot axis which is eccentrically located with regard to the longitudinal plane of symmetry of the casting table. During their pivoting movement the strands are pulled against the supporting member. After the pivoting movement has been completed, the strands are moved off the supporting member and are conveyed to a collecting station. The strands leave the collecting station and after having been individually subjected to a turning movement so that the strands are supported on one of their broad sides, the thus supported strands are conveyed to any desired place.

11 Claims, 8 Drawing Figures

DEVICE FOR HANDLING CONTINUOUSLY VERTICALLY CAST RECTANGULAR STRANDS, ESPECIALLY OF ALUMINUM AND ALUMINUM ALLOYS

The present invention relates to a device for producing semicontinuously vertically cast rectangular strands, especially of aluminum and aluminum alloys. These strands are simultaneously, and located adjacent to each other lowered by an upwardly and downwardly movable casting table and are then brought into engagement with a supporting beam and by a pivoting movement coupled with the upward movement of the casting table, of the dummy bars which are operatively connected to the casting table and of the supporting beam are brought into an approximately horizontal position relative to the casting table. Subsequently the strands are moved away from the supporting beam, are collected and are conveyed to a further processing station.

The device comprises a supporting beam driven by rollers and also comprises a transporting device which follows the supporting beam. The supporting beam is pivotable about a rotatable axis which is locally stationary relative to the casting table and through rollers rests on a guiding path in such a way that the supporting beam, during the upward movement of the casting table, over which a plurality of dummy bars are held for pivoting toward the supporting beam, starting from the approximately vertical position in its lowered position, is brought into an approximately horizontal position.

A method of and a device of the just described type are disclosed in German Pat. No. 1 608 768. The supporting beam of this known device has one end linked to the casting table and its opposite end is by means of rollers held in a curved stationary guiding path. The dummy bars which enable the starting of the pertaining continuous casting plant are linked to the center of the casting table. After completion of the casting operation, the strands located adjacent to each other on the casting table are by means of a push-over device pressed against the supporting beam while the dummy bars carry out the above mentioned pivoting movement. The discharge of the strands is effected by means of a hydraulic cylinder piston system which moves the casting table upwardly.

After the casting table has reached its uppermost position, the supporting beam with the strands located on a broad side occupies a horizontal or nearly horizontal position. The strands are by means of the driven rollers of the supporting beam moved to a collecting device and from the latter are by means of a transporting device conveyed to a further processing station. The collecting device which follows the supporting beam makes it possible to free the supporting beam from the strands and to prepare the continuous casting plant without any major losses in time for the next casting operation.

The drawback of this method and device, which is utilized exclusively when continuously casting copper and copper alloys, consists in that the strands are located on the casting table in such a way that one of their broad sides faces the supporting beam. This arrangement requires, when simultaneously lowering a plurality of strands, a considerable width of the casting table. A further drawback of this known method and device is seen in the fact that after completion of the casting operation care has to be taken that the strands are from their vertical casting position pressed against the supporting beam.

It is therefore an object of the present invention to develop a device of the above described general type which, while avoiding the above mentioned drawbacks, will permit the casting of strands with rectangular cross section, especially of aluminum and aluminum alloys.

It is a particular object of the present invention so to develop the device that an economical production of strands of the mentioned materials will be possible while extreme dimensions of the strand casting plant will be avoided and a great number of strands of relatively large dimensions can be produced.

These objects and other objects and advantages of the invention will appear more clearly from the following specification in connection with the accompanying drawings, in which:

FIG. 1 diagrammatically illustrates a section through the discharging device proper which comprises a supporting beam and which is equipped with a casting table shown in its lowered position.

FIG. 1*a* is an enlarged side view of the supporting beam in FIG. 1 above its axis of rotation.

FIG. 1*b* is an enlarged top view of the supporting beam in FIG. 1 at a point where it supports two rollers.

FIG. 1*c* is an enlarged view of the casting table in FIG. 1 in the region of the dummy bars and arresting device (the hydraulic cylinder piston unit for raising and lowering the casting table as shown in FIG. 1 has been removed for sake of clarity).

FIG. 1*d* is an enlarged top view of the base plate with several dummy bars as per FIG. 1 (the non-illustrated other side section is the exact opposite (mirror image) of the side section shown).

The device according to the present invention is characterized primarily in that the strands are cast in such a way that one of their narrow sides is located opposite the supporting beam and that during pivoting movement the strands are pulled against the supporting beam and during the upward movement of the casting table are pivoted about a pivot point which is located eccentrically with regard to the center line of the casting table. After leaving the supporting beam and a collecting device, the strands are individually subjected to a turning movement while being further conveyed on their broad sides.

Figure 1:
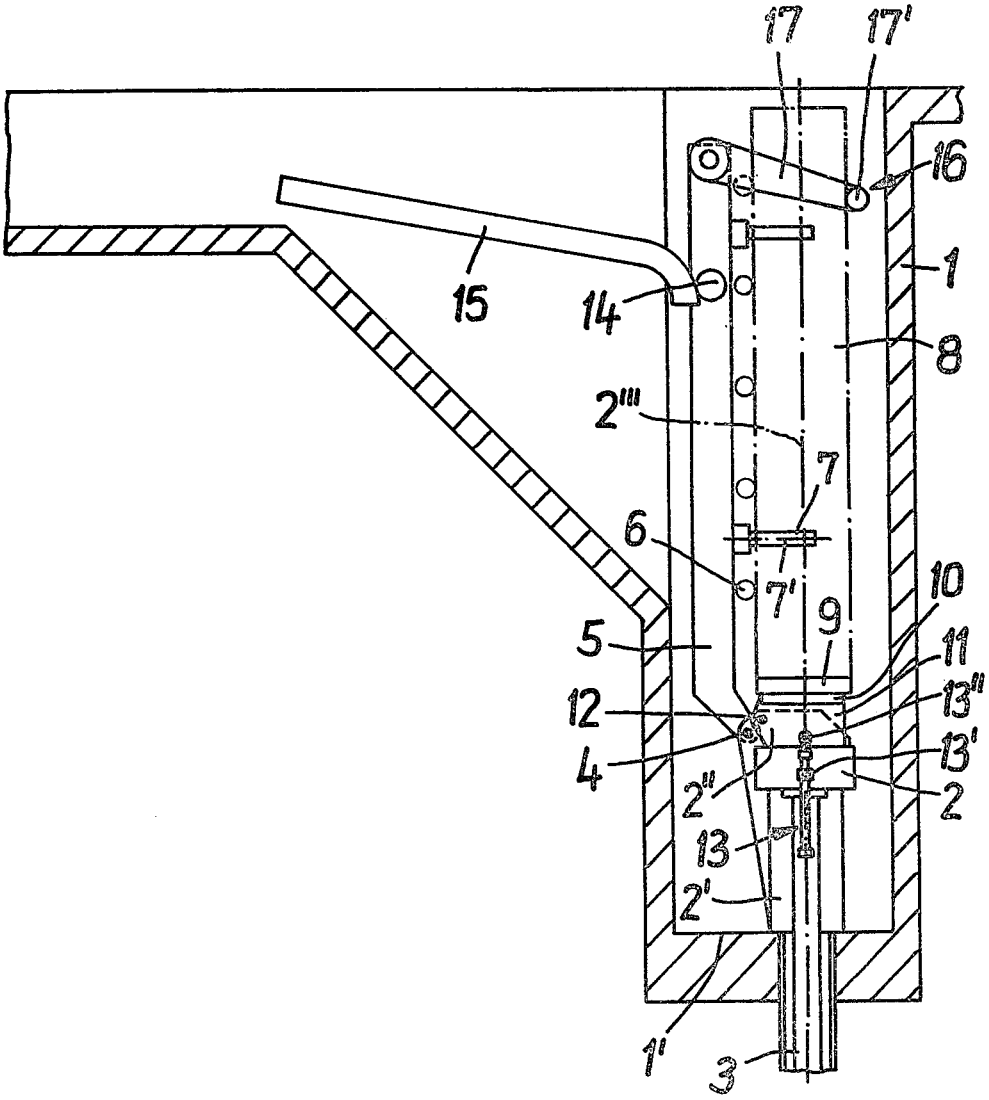
Figure 1A:
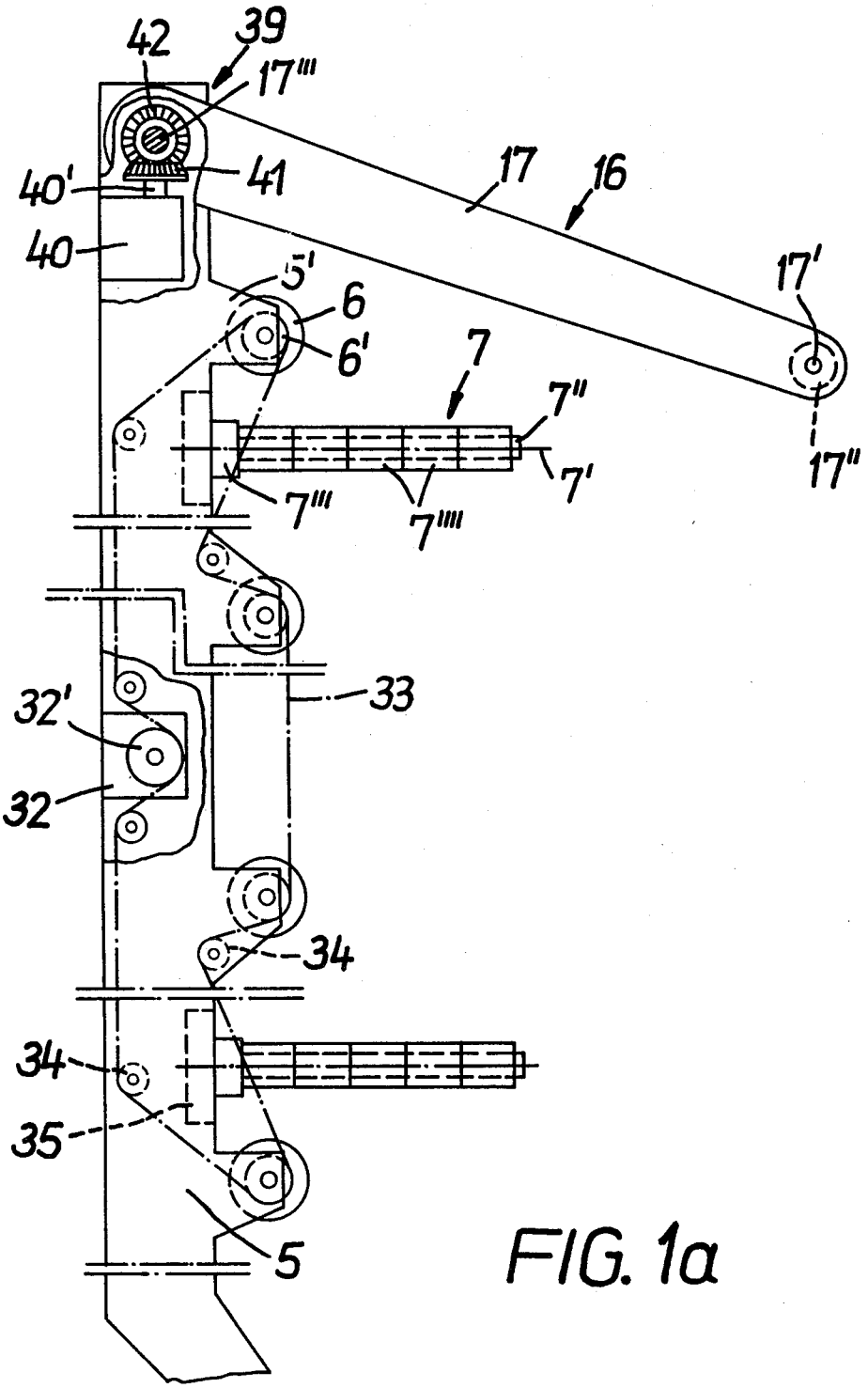

Referring now to the drawings in detail, it will be seen that below the non-illustrated casting unit there is arranged a casting table 2 in a shaft or pit 1. The casting table 2 is adapted by means of a hydraulic cylinder piston unit 3 to be adjusted as to height. The casting table 2 rests in its lowermost position, which it occupies after completion of a casting operation, through the intervention of a leg 2' on the bottom 1' of the shaft 1. The upper end section of the casting table 2, which end section is designed in the form of a bracket 2'', is through a rotatable pin or axle 4 connected to a supporting beam 5 which in its inwardly directed side supports driven rollers 6 and is provided with guiding forks 7. The rollers 6 have sprockets 6' on their end sections, are mounted on the supporting brackets 5' of the supporting beam 5, and are driven by a motor 32, preferably hydraulic, mounted on the supporting beam (FIGS. 1*a, b*). This motor drives the rollers 6 via a driving gear 32' and an endless chain 33 engaging the sprockets 6'. The supporting beam is fitted with return pulleys 34 at both ends of the rollers 6 for guiding and tensioning the endless chain.

Figure 1B:
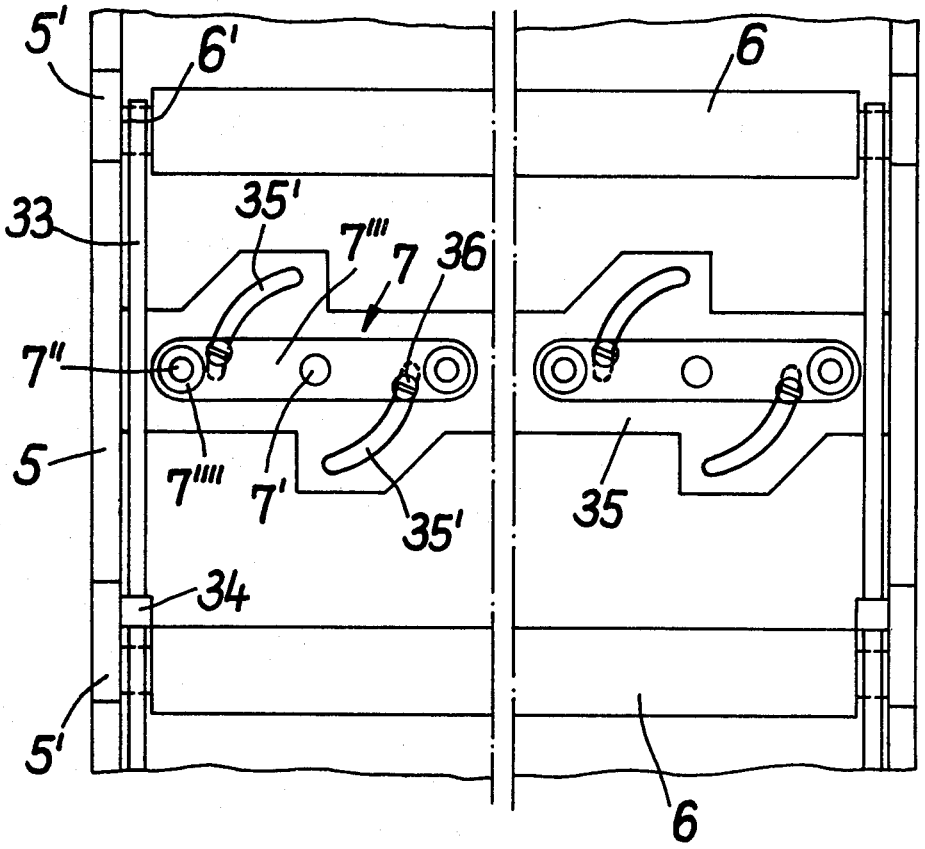

The guiding forks 7 consist essentially of two prongs 7'' and a transverse piece 7''' which supports the fork prongs and is pivotable about a pin 7' arranged perpendicular to the supporting beam 5 to accommodate different strand dimensions (FIGS. 1*a, b*). Each transverse piece 7''' is supported by a transverse plate 35 which is fastened to supporting beam 5 away from the rollers 6. Depending on the number of strands to be handled at one time, several guiding forks 7 are arranged side by side on each transverse plate 35 (FIG. 1*b*).

On the transverse plate for each guiding fork 7 there is at least one rounded recess 35' permitting the transverse piece 7''' to be fixed in a position matching the strand dimensions, if necessary diagonal to the long axis of the transverse plate. The transverse piece 7''' is fastened to the transverse plate by means of set screws 36 which extend through the recesses 35' and engage nuts (not shown) underneath the transverse plate. To facilitate removal of the strands held between the fork prongs 7'' the latter are equipped with rollers 7''''.

Figure 1C:
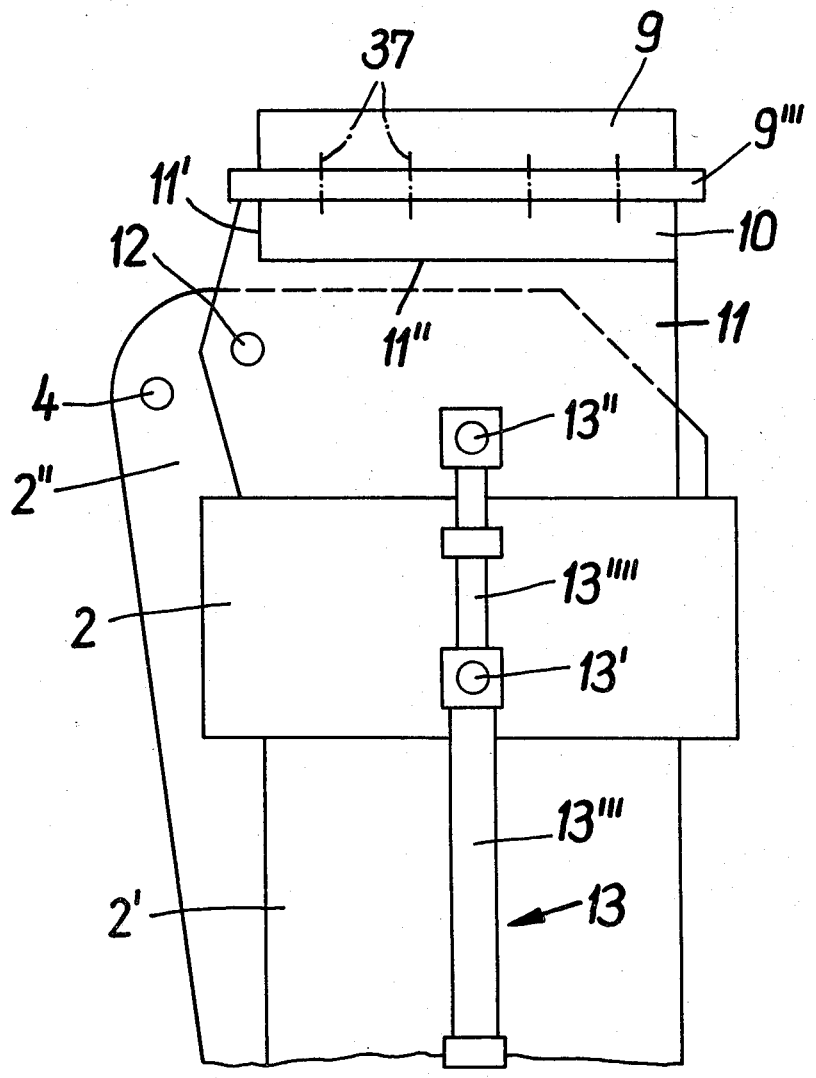
Figure 1D:
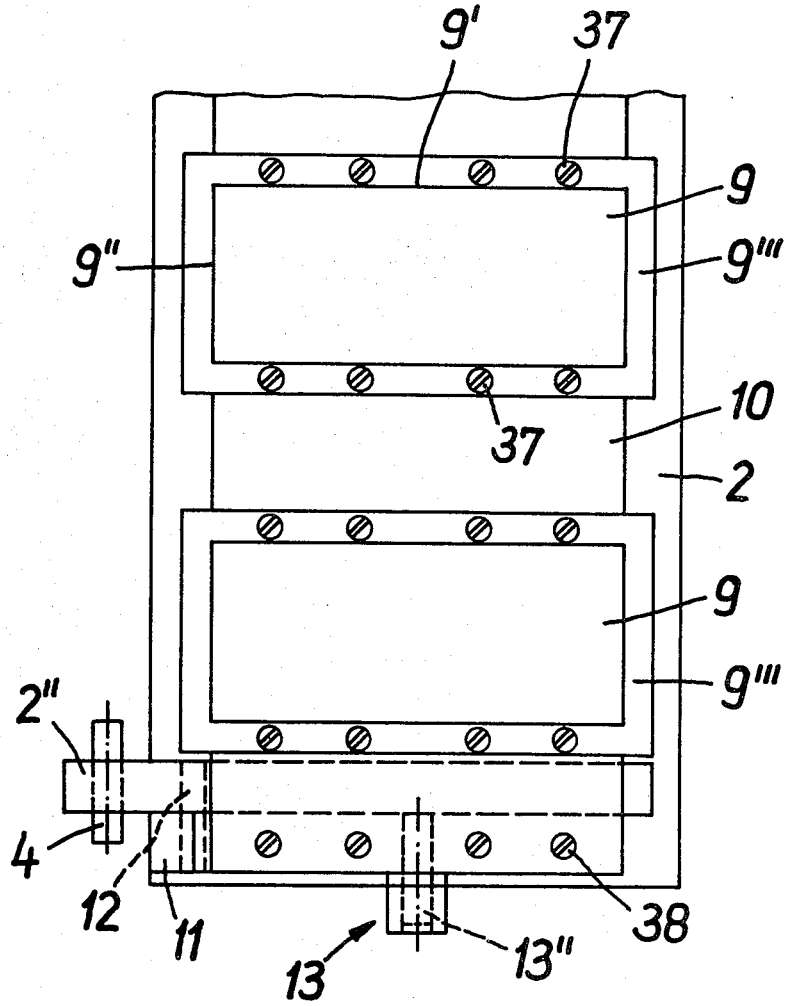

The upright strands 8, i.e. having a narrow side facing the supporting beam 5 (see also FIG. 3), are mounted on the dummy bars 9 whose dimensions on the broad sides 9' and narrow sides 9'' match those of the strands 8 and which are arranged on a common base plate 10 (FIG. 1*d*). The dummy bars 9 are fastened to the base plate 10 with screws 37, at least along the broad sides 9', that pass through a mounting shoulder 9''' (see also FIG. 1*c*). The unit composed of the parts 9 and 10 is exchangeably fitted into a table plate 11 which through the intervention of rotatable pins 12 is linked or pivotally connected to brackets 2'' of the casting table 2. The pins 12 are arranged eccentrically with regard to the center line 2''' of the casting table 2 and preferably are in alignment with the narrow side of the dummy bars 9 which narrow sides face the supporting beam 5.

Interchangeability of the unit consisting of parts 9 and 10 is possible in that each end of the base plate 10, i.e. adjacent to the brackets 2'', rests in a recess in the casting table 11 with faces 11' and 11'' and the base plate is removably attached to the latter face by means of screws 38 (FIGS. 1*c, d*).

Each of the pins 12 is located below the base plate 10 and is preferably arranged in spaced relationship to and above the pin 4 of the supporting beam 5. Centrally connected to the table plate 11 from the outside is an arresting device 13 consisting of a hydraulic cylinder piston unit; the latter's casing 13''' is connected to the casting table 2 via a rotatable pin 13'', while the associated piston 13'''' is connected to the table plate 11 via a rotatable pin 13'' (FIG. 1*c*).

The arresting device 13 serves to pivot the dummy bars 9 back toward the casting table 2 after the discharge operation has been completed and, by holding the table plate 11 in position on the casting table 2, to keep the dummy bars immovable relative to it so that frictional forces between the strands and the ingot molds (not shown) occurring during casting can be absorbed during downward movement of the casting table 2.

The supporting beam 5 which after completion of the casting operation, i.e. during the lowered position of the casting table, is arranged vertically, has that side thereof which faces away from the pin 4 provided with rollers 14 by means of which the supporting beam rests on a suitably curved stationary guiding path 15.

The supporting beam 5 is on that side thereof which faces away from the pin 4 furthermore provided with an entraining or taking-along device 16 which is provided with pivotable arms 17 arranged in spaced relationship to each other and also with a transverse bar 17' connected to the pivotable arms 17. The transverse bar 17' supports one or a plurality of rollers 17''. The taking-along device 16 has a hydraulic drive 39 consisting of a hydraulic motor 40 with bevel gearing having the bevel gear wheels 41 and 42; the former is rigidly connected with the drive shaft 40' of the hydraulic motor mounted on the supporting beam 5 and the latter rigidly with the pivotable shaft 17''' of the taking-along device 17 (FIG. 1*a*). The transverse bar 17' supports one or several rollers 17'' (see also FIG. 3).

The taking-along device 16 can as a modification to the embodiment just described also be advantageously provided with a hydraulic drive (not shown) consisting of two laterally arranged hydraulic piston units as generally known. Their components, i.e. the pistons and casings, are hinge-mounted on the supporting beam 5 and the pivotable arms 17 of the taking-along device 16.

The guiding forks 7 can—different from the embodiment described above—also be adapted to the various strand dimensions in that the fork prongs 7' are adjustably mounted on the transverse piece 7''' by means of an eccentric (not shown) (see also FIG. 1*a*). By moving this eccentric the space between the two prongs 7' of a fork can be increased or reduced.

After completion of a casting operation, the device 16 is moved relative to the supporting beam 5 in such a way that the transverse bar 17' together with the pertaining rollers is located behind the narrow sides of the adjacent strands 8 which narrow sides face away from the supporting beam 5. When the casting table 2 moves upwardly, the transverse bar 17' first rolls slightly on the rear narrow sides of the strands 8. When the casting table 2 is moved further upwardly, the strands 8 are positively taken along by the device 16 until the critical tilting angle of the table plate 11 has been exceeded and the strands 8, due to their own weight, engage the rollers 6 of the supporting beam 5.

Figure 2:
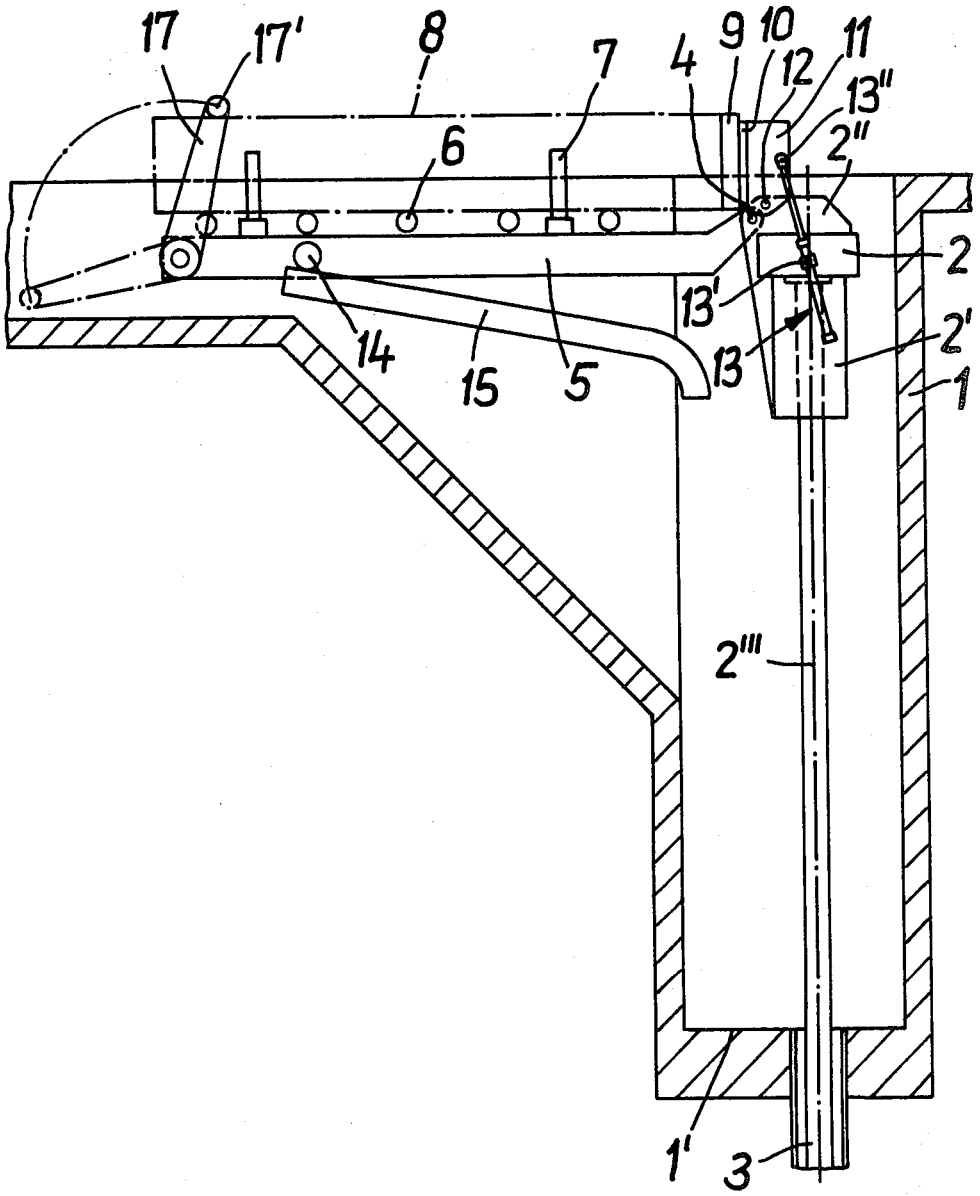
FIG. 2 represents a section through the discharging device according to FIG. 1 with the casting table occupying its horizontal position and with the supporting beam in its horizontal position.

The guiding path 15 is so arranged and designed that the supporting beam 5 and the strands 8 occupy a horizontal position as soon as the casting table 2 has completed its discharging movement which means has reached its uppermost position (FIG. 2). The dummy bars 9 with pertaining base plate 10 and table plate 11, which in the uppermost position of the casting table 2 are located horizontally, are by means of the arresting device 13 pivoted back by 90° in the direction toward the casting table 2 after the strands 8, which are laterally held by the guiding forks 7, have been moved away from the supporting beam 5 by the driven rollers 6. Prior to the initiation of the moving-away operation, the device 16 is pivoted into a position in which it does not interfere with the movement of the strands (see dot-dash line position in FIG. 2).

The guiding forks 7 (FIG. 3) are preferably so designed that the pertaining fork prongs are respectively associated only with one strand 8.

Figure 3:
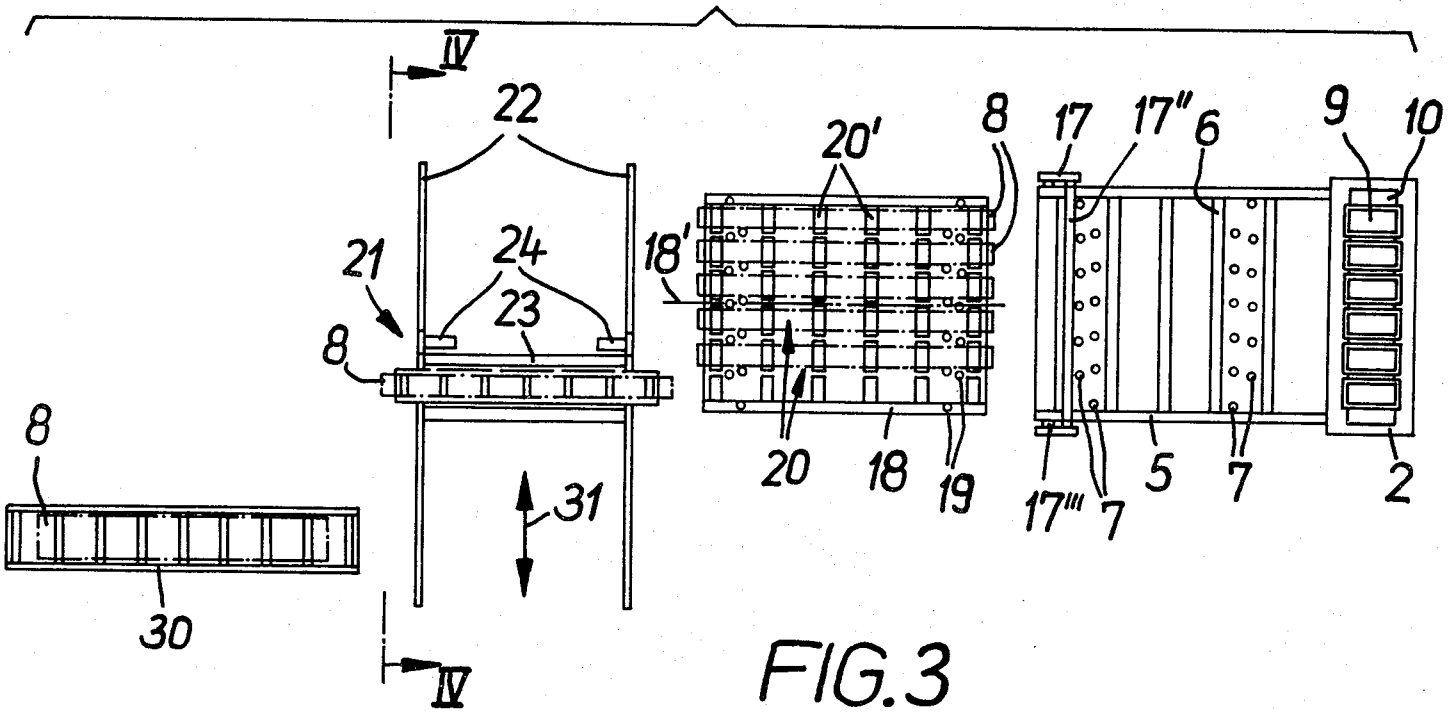
FIG. 3 represents a diagrammatic illustration of a top view of the entire device with the roller bed following the supporting beam and with a following transversely movable turning device as well as with a next following transporting device.

The entire arrangement illustrated in FIG. 3 comprises a casting table 2 with a base plate 10 provided with six dummy bars 9 arranged adjacent to each other. The supporting beam 5 is followed by a roller bed 18 with individually driven roller bed sections the number of which corresponds to the number of the strands 8. The individual roller sections have, for supporting the still upright strands 8, associated therewith guiding forks 19 which as to their function and construction correspond to the guiding forks 7.

The roller bed 18 serves as collecting device which makes it possible immediately to free the supporting beam 5 from the strands 8 after the horizontal position of the supporting beam has been reached to thereby prepare the next casting operation.

The individual drives of the roller bed sections comprised of the roller beds 20 are not illustrated. Preferably they are arranged like the drive for the rollers 6 of the supporting beam 5 (see also FIG. 1*a*), i.e. each roller bed 20 is provided with a motor corresponding to the motor 32 which drives the rollers 20' of the roller bed via an endless chain. On at least one side of the roller bed there are sprockets corresponding to the sprockets 6' and return pulleys corresponding to the return pulleys 34. Furthermore the individual drives of the roller bed sections 20 are preferably so arranged that they can be synchronized for conveying the strands 8 away from the supporting beam 5. It is thus possible to free the supporting beam 5 in a minimum of time from the strands 8 to thereby make the supporting beam 5 again available for the next casting operation.

Figure 4:
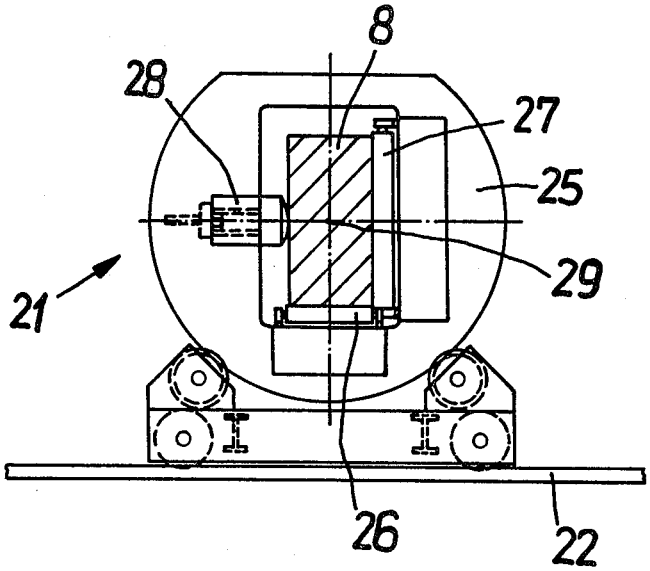
FIG. 4 illustrates on a larger scale than that of FIGS. 1, 2 and 3 a side view of the turning device according to line IV—IV in FIG. 3.

The entire arrangement furthermore comprises as an essential component a turning device 21 which comprises a carriage 23 which is movable on rails 22 perpendicular to the longitudinal axis 18'. This carriage 23 supports a rotatable core 25 driven by motors 24. The cage 25 comprises two driven roller beds 26 and 27 respectively which are located perpendicular to each other. The roller bed 27 which faces the broad side of the strands is located opposite to clamping devices 28 which keep the strand 8 to be placed on its broad side in engagement with the roller bed 27. The clamping part of the clamping devices 28 is preferably equipped with at least one roller (FIG. 4).

The axis of rotation 29 of the turning device 21 is preferably so arranged that the strand 8, independently of its width dimensions, occupies the desired position in height when it rests on the horizontal roller bed 27 after the completion of its 90° turning movement. The turning device is expediently so designed that, when turning the strand onto one of its broad sides, any difference as to height between the roller bed 18 and a subsequent transporting device 30 will be equalized. The strands 8 resting on the roller beds 20 are by means of a turning device 21, which is movable in the direction of the double arrow 31, individually withdrawn, are by turning them by 90° placed on one of their broad sides, are then by means of the driven roller bed 27 transferred to the following transporting device 30 and are from the latter conveyed to a further processing station.

As will be evident from the above, the advantage of the common tilting movement of the dummy bars about a pivot point which is eccentric with regard to the casting table consists in that these dummy bars can have a low height and thus a low weight, and that the casting table does not have to be provided with special recesses which would be necessary if the dummy bars were arranged centrally on the casting table and were connected with the casting table by a pivot point provided at their foot portions.

The arrangement of the invention according to which the pin 12 is located in alignment with the extension of those narrow sides of the strands 8 which face toward the supporting beam 5, has the advantage that the casting table is with strands of lesser widths, subjected to a load in the direction toward the supporting beam. However, since the casting table is any how to be designed so as to be able to absorb the considerably higher transverse forces exerted by the linked-on supporting beam and the strands resting thereon, this relatively low eccentric stress can be disregarded. While the possible eccentric arrangement of the dummy bars with regard to the center line of the casting table furthermore may bring about that the strands with the pertaining dummy bars have to be pressed with considerable force from the vertical casting position against the supporting beam, the device according to the present invention is provided with an entraining or taking along system which is preferably designed as a pivotable roller. This taking-along system according to the present invention, which is preferably equipped with a hydraulic drive, rolls at the start of the discharging movement of the casting table along the rear narrow sides of the strands so that the strands are automatically pulled against the supporting beam. The particular advantage of this device equipped with one or more rollers, therefore, consists in that the moving operations caused by the movement of the casting table can be taken advantage of for moving the strands, without the employment of an additional pushing-over device, from their stable vertical position to the supporting beam.

It is, of course, to be understood that the present invention is, by no means, limited to the specific showing in the drawings but also encompasses any modifications within the scope of the appended claims.

I claim:

1. A device for handling semi-continuously vertically cast rectangular strands, especially of aluminum and aluminum alloys which includes: a casting table vertically reciprocable from a lower first position to an upper second position and vice versa, a longitudinal supporting member having a strand supporting surface and being pivotally connected to said casting table, means arranged for cooperation with said supporting member to support and guide said support mechanisms at various positions, said casting table being operable in said first position in cooperation with said last mentioned means to hold said supporting member in at least nearly vertical position and to support a vertically cast rectangular strand in upward position with its narrow side in engagement with said supporting member, holding means operatively connected to said supporting member for holding there against a cast strand engaging said supporting member in said first position of said casting table, said casting table also being operable when being moved from said first position into said second position to pivot said supporting member into an at least nearly horizontal position, dummy bars for supporting an end face of a strand, a common base plate having said dummy bars connected thereto and forming an exchangeable unit, a table plate forming part of said casting table and having said exchangeable unit fitted therein, said table plate being pivotally connected to said casting table for pivoting about an axis eccentrically arranged with regard to the longitudinal plane of symmetry of said casting table, and an arresting device operatively connected to said table plate for non-movably connecting said base plate to said casting table.

2. A device according to claim 1, in which said axis about which said table plate is pivotable is located substantially in a plane defined by said supporting surface which surface is adapted to contact said cast strand.

3. A device according to claim 1, in which said holding means comprises arms pivotally connected to said supporting member, a transverse bar connected to those ends of said arms which are remote from a pivotal connection thereof with said supporting member, and at least one roller carried by said transverse bar, said holding means being operable to embrace a cast strand engaged by said supporting member in its at least nearly vertical and horizontal positions.

4. A device according to claim 1, in which said dummy bars and said base plate for a unit adapted exchangeably to be received in said table plate linked to said casting table.

5. A device according to claim 1, which includes means for holding said dummy bars stationary during the downward movement of said casting table to said first position.

6. A device according to claim 1, in which said supporting member is provided with guiding forks disposed at intervals across the supporting surface of said supporting member adapted to guidingly engage the broad sides of a cast strand on said supporting member in the at least nearly horizontal position of said supporting member, said guiding forks being adjustable in conformity with the dimensions of the respective cast strands.

7. A device according to claim 6, in which said guiding forks are equipped with rollers and are rotatable about axes arranged normal to said supporting member supporting surface.

8. A device according to claim 1, in which said supporting member includes rollers arranged for supporting contact with said cast strand supported by said casting table in said second position, said dummy bars being so arranged on said base plate that the distance between said cast strand facing said supporting member and one of said rollers adjacent said casting table in said second position is approximately zero.

9. A device according to claim 8, which includes a roller bed following said supporting member and provided with adjustable guiding forks adapted for guiding engagement with the broad sides of cast rectangular strands withdrawn from said supporting member.

10. A device according to claim 9, which includes a turning device displaceable in a direction perpendicular to the longitudinal axis of said roller bed, said turning device being provided with guiding rollers arranged substantially perpendicular to each other and rotatable about a common substantially horizontal axis for receiving individual strands from said roller bed while shifting the support of the respective strand from a narrow side thereof to a broad side thereof.

11. A device according to claim 10, which includes a transporting device following said turning device, and in which said common substantially horizontal axis is so arranged that the difference in height between the rollers of said supporting member and the receiving surface of said transporting device is equalized when turning the strands so as to be supported on the broad side thereof.

* * * * *